United States Patent [19]

Brown et al.

[11] Patent Number: 4,917,173

[45] Date of Patent: Apr. 17, 1990

[54] MONOGROOVE LIQUID HEAT EXCHANGER

[75] Inventors: Richard F. Brown, Bethpage; Fred Edelstein, Hauppauge, both of N.Y.

[73] Assignee: The United States of America as represented by the National Aeronautics and Space Administration, Washington, D.C.

[21] Appl. No.: 271,266

[22] Filed: Nov. 15, 1988

[51] Int. Cl.[4] ..... F28D 15/02; F28F 27/00

[52] U.S. Cl. ..... 165/13; 165/32; 165/41; 165/111; 165/104.26; 165/104.25; 122/366

[58] Field of Search ..... 165/13, 32, 104.25, 165/104.26, 41, 111; 122/366

[56] References Cited

U.S. PATENT DOCUMENTS

| | | | |
|---|---|---|---|
| 3,875,926 | 4/1975 | Frank | 126/271 |
| 4,492,266 | 1/1985 | Bizzell et al. | 165/104.26 |
| 4,495,988 | 1/1985 | Grossman | 165/96 |
| 4,515,207 | 5/1985 | Alario et al. | 165/1 |
| 4,583,587 | 4/1986 | Alario et al. | 165/104.26 |
| 4,664,177 | 5/1987 | Edelstein | 165/104.26 |
| 4,687,048 | 8/1987 | Edelstein et al. | 165/104.26 |
| 4,750,543 | 6/1988 | Edelstein | 165/41 |

*Primary Examiner*—Albert W. Davis, Jr.
*Attorney, Agent, or Firm*—Hardie R. Barr; John R. Manning; Edward K. Fein

[57] ABSTRACT

A liquid supply control is disclosed for a heat transfer system which transports heat by liquid-vapor phase change of a working fluid. An assembly (10) of monogroove heat pipe legs (15) can be operated automatically as either heat acquisition devices or heat discharge sources. The liquid channels (27) of the heat pipe legs (15) are connected to a reservoir (35) which is filled and drained by respective filling and draining valves (30, 32). Information from liquid level sensors (50, 51) on the reservoir (35) is combined (60) with temperature information (55) from the liquid heat exchanger (12) and temperature information (56) from the assembly vapor conduit (42) to regulate filling and draining of the reservoir (35), so that the reservoir (35) in turn serves the liquid supply/drain needs of the heat pipe legs (15), on demand, by passive capillary action (20, 28).

20 Claims, 1 Drawing Sheet

FIG. 1
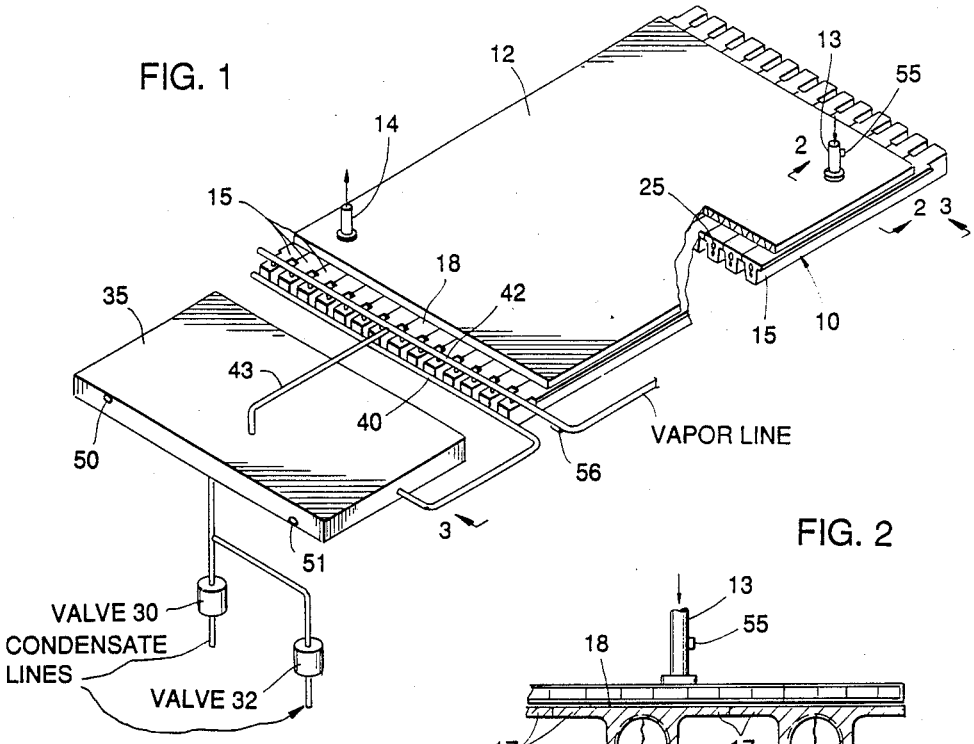
FIG. 2
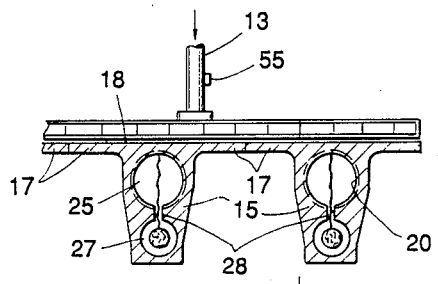
FIG.3
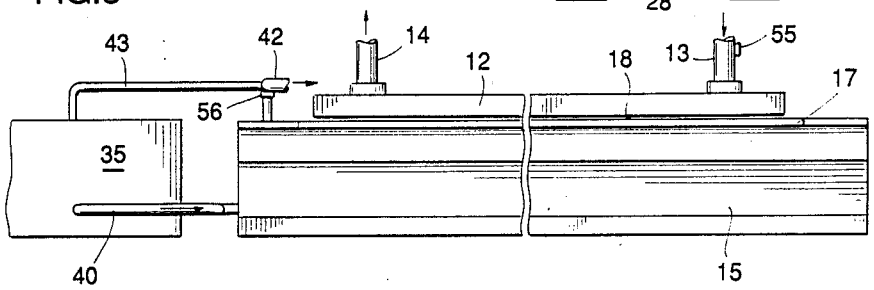
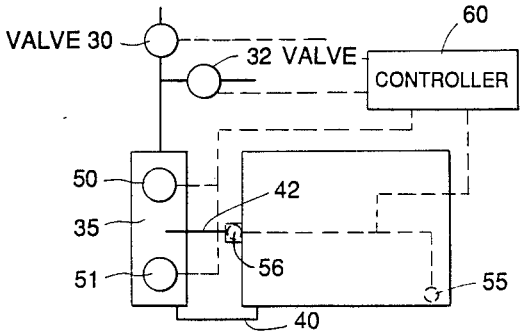
FIG. 4

MONOGROOVE LIQUID HEAT EXCHANGER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

The present invention relates to heat management systems, and more particularly to a high efficiency heat transfer system for transporting heat to and from a plurality of heat sources and/or heat sinks utilizing liquid-vapor phase change of a working fluid in a monogroove heat pipe assembly. Although described in the context of spacecraft and space station applications, the present invention has substantial utility as well in terrestrial applications.

The thermal management of large orbiting spacecraft is expected to utilize two-phase heating and cooling loops which require heat transfer devices that can transfer heat both to and from other other fluid heat transport loops. The monogroove liquid heat exchanger has the potential for accomplishing this, particularly if a way can be found for effectively counteracting the tendency, under some operational conditions, of the monogroove heat pipes in the heat pipe assembly to either flood or dry out.

Prior efforts to solve these problems have not been entirely satisfactory. For example, in one design liquid was pumped directly into the monogroove legs through a valve under the control of an ultrasonic sensor located on one of the legs of the assembly. Unfortunately this resulted in uneven flow distribution between the legs, as well as local heating effects. Consequently, the sensor did not always control the solenoid valve properly, resulting in flooding of the plate and excess liquid exiting the plate along with the vapor stream.

Another design provided a reservoir between the liquid supply line and a common liquid header for the monogroove legs. Since the reservoir allowed liquid to be transported passively upon demand into the cold plate, the problem of uneven flow distribution was largely eliminated. There were, however, valve control problems under certain conditions, and the configuration was operable only as a cold plate, not reversibly for automatically supplying either heat or cold as needed according to system demands.

While there is considerable prior art relating to this technology, there appears to be none which teaches or suggests satisfactory solutions to these problems. This art includes, for example, U.S. Pat. No. 3,875,926 (Frank), issued Apr. 8, 1975, which teaches a plurality of heat pipes having a common manifold which supplies fluid to the heat pipes from a reservoir.

U.S. Pat. No. 4,583,587 (Alario et al.), issued Apr. 22, 1986, discloses a multi-leg heat pipe evaporator comprising a plurality of monogroove heat pipe legs welded together at their flanges to form a flat mounting plate. The monogroove heat pipe legs disclosed are of the type preferred for use in the present invention.

U.S. Pat. No. 4,515,207 (Alario et al.), issued May 7, 1985, discloses a monogroove heat pipe design of similar type.

U.S. Pat. No. 4,067,237 (Arcella), issued Jan. 10, 1978, discloses a heat pipe combination wherein two heat pipes are combined in opposing relationship to form an integral unit such that the temperature, heat flow, thermal characteristics, and temperature-related parameters of a monitored environment or object exposed to one end of the heat pipe combination can be measured and controlled by controlling the heat flow of the opposite end of the het pipe combination.

U.S. Pat. No. 4,492,266 (Bizzell et al.), issued Jan. 8, 1985, discloses a system including an evaporator 12 connected to a heat exchanger 26 from which liquid is pumped by means of pump 11 to the evaporator 12.

U.S. Pat. No. 4,495,988 (Grossman), issued Jan. 29, 1985, discloses a controlled heat exchanger system comprising a controller adapted to control the vapor pressure in the vapor chamber.

U.S. Pat. No. 4,635,709 (Altoz), issued Jan. 13, 1987, discloses a dual mode heat exchanger 10 for cooling airborne electonics 12 through a cold plate 14. The heat exchanger either radiates heat to air through radiator fins 18 or absorbs heat by evaporative cooling. The liquid coolant contained in grooves 16 of the cold plate 14 boils at a preselected temperature and thereby absorbs heat energy. Vapor released by the boiling liquid is exhausted through a hydrophobic filter membrane 24.

Other patents of possible interest include: U.S. Pat. No. 3,741,289 (Moore), issued June 26, 1973; U.S. Pat. No. 4,414,961 (Luebke), issued Nov. 15, 1983; U.S. Pat. No. 4,566,527 (Pell et al.), issued Jan. 28, 1986; U.S. Pat. No. 3,958,627 (Edelstein), issued May 25, 1976; U.S. Pat. No. 4,457,059 (Alaria et al.), issued July 3, 1984; U.S. Pat. No. 4,470,451 (Alario et al.), issued Sept. 11, 1984; U.S. Pat. No. 4,520,865 (Bizzell), issued June 4, 1985; U.S. Pat. No. 4,545,427 (Alario et al.), issued Oct. 8, 1985; U.S. Pat. No. 4,565,243 (Ernst et al.) issued Jan. 21, 1986; U.S. Pat. No. 4,616,699 (Grote), issued Oct. 14, 1986; U.S. Pat. No. 4,627,487 (Basiulis), issued Dec. 9, 1986; U.S. Pat. No. 4,632,179 (Meijer et al.), issued Dec. 30, 1986; and U.S. Pat. No. 4,653,471 (Takeuchi et al.), issued Mar. 31, 1987.

A need therefore remains for a new and improved monogroove plate heat pipe assembly, and in particular for an improved liquid supply control apparatus and method for such as assembly which effectively provides for automatic operation in both heating and cooling modes according to system needs. Such a method and apparatus should therefore automatically determine whether liquid should be supplied to or drained from the heat pipe assembly as a function, respectively, of whether heat is being supplied to it or removed from it. Further, the liquid needs to be managed such that neither flooding nor localized drying takes place in any of the legs in the heat pipe assembly. Preferably, the method and apparatus will also include appropriate control logic for carrying into effect the automatic operation of the system as either an evaporator or condenser for the working fluid, consistently with these other requirements and needs.

SUMMARY OF THE INVENTION

The present invention meets the above needs and purposes with a new, automatic, and reversible liquid supply control for a monogroove liquid heat exchanger configuration. The invention is suitable for automatically controlling the amount of liquid to and from a plurality of heat acquisition/discharge devices or sources, thereby making it particularly applicable to large system heat management applications, such as in large, orbiting spacecraft.

The monogroove liquid heat exchanger is an assembly consisting of a plurality of monogroove heat pipe legs welded together at their flanges to form a flat surface. A reservoir having liquid level sensors and filling and draining solenoid valves is connected to the liquid channels in the heat pipe assembly through a common liquid header. Information from the liquid level sensors is combined with temperature information from the monogroove liquid heat exchanger and its vapor to regulate filling and draining of the reservoir. The device can be operated in dual modes by a thermocouple and liquid level sensor control logic, for either heating or cooling such heat acquisition/discharge devices by reversing the flow of liquid through the monogroove heat pipes, wherein in one direction liquid is vaporized for cooling, and in the other direction vapor is condensed for heating. The control logic technique for the dual mode operation is particularly advantageous, effective, and efficient.

Heat is preferably exchanged with a plate-type heat exchanger. The plate-type heat exchanger, equipped with a liquid inlet and liquid outlet, is preferably brazed, bonded, or mechanically clamped to the flat surface of the monogroove heat exchanger assembly.

It is therefore an object of the present invention to provide a new and improved method and apparatus for controlling the liquid supply for a heat transfer system for transporting heat by liquid-vapor phase change of a working fluid in a monogroove heat pipe assembly; such a method and apparatus which can effectively provide for automatic operation in both heating and cooling modes according to sytemm needs; which automatically determines whether liquid should be supplied to or drained from the heat pipe asssembly as a function, respectively, of whether heat is being supplied to it or removed from it; which manages the liquid such that neither flooding nor localized drying takes place in any of the legs in the heat pipe assembly; which includes appropriate control logic for carrying into effect the automatic operation of the system as either an evaporator or condenser for the working fluiid; which includes a monogroove heat pipe assembly formed of a plurality of monogroove heat pipe legs joined to one another; in which the heat pipe assembly includes liquid and vapor headers coupled respectively to the liquid and vapor channels of the monogroove heat pipe legs in the assembly; in which a liquid reservoir is connected to the liquid header; which includes a vapor line for the working fluid vapor phase; in which the vapor line is operatively connected to the vapor header for supplying and receiving vapor according to the demands of the header; which includes liquid supply and condensate return lines for the liquid phase of the working fluid; in which a fill valve operatively connects the liquid supply line to the liquid reservoir; in which a condensate return valve operatively connects the condensate return line to the liquid reservoir; which includes a valve control means responsive at least to liquid in the reservoir and connected to the fill and return valves for controlling the valves to admit liquid to the reservoir when the reservoir is becoming depleted and to drain liquid from the reservoir when the reservoir is becoming filled, to cause liquid to enter the resevoir when the heat pipe assembly is evaporating the working fluid, and to cause liquid to exit the reservoir during operation of the heat pipe assembly as a condenser for the working fluid; in which the heat pipe legs may be grooved capillary plate heat exchangers; which may include liquid presence sensing means located on the liquid reservoir and connected to the valve control means for indicating the presence of liquid in the reservoir; in which the liquid presence sensing means may include at least two ultrasonic liquid presence sensors located to detect low and high liquid levels in the reservoir; in which alternatively one ultrasonic liquid presence sensor may be located to detect full or empty liquid levels in the reservoir; which may include temperature sensing means connected to the valve control means and located for sensing the vapor temperature and the temperature of the heat pipe assembly; in which the temperature sensing means may include at least two thermocouples, one located on the heat exchanger, and the other on the vapor line of the heat pipe assembly; in which the valve control means may be operated such that it opens the condensate return valve and closes the fill valve when the liquid sensing means indicates that the reservoir is substantially full and the temperature sensing means indicates that the vapor temperature is greater than the heat exchanger temperature by a predetermined amount; in which the valve control means may be operated such that it closes the condensate return and fill valves when the liquid sensing means indicates that the reservoir is substantially empty and the temperature sensing means indicates that the vapor temperature is greater than the heat exchanger temperature by a predetermined amount; in which the valve control means may be operated such that it closes the condensate return valve and opens the fill valve when the liquid sensing means indicates that the reservoir is substantially empty and the temperature sensing means indicates that the vapor temperature is less than the heat exchanger temperature; in which the valve control means may be operated such that it closes the condensate return and fill valves when the liquid sensing means indicates that the reservoir is substantially full and the temperature sensing means indicates that the vapor temperature is less than the heat exchanger temperature; in which the valve control means may be operated such that the condensate return valve is open for a predetermined time and the fill valve is open for a predetermined time; and to accomplish the above objects and purposes in an inexpensive, uncomplicated, durable, versatile, and reliable method and apparatus, inexpensive to manufacture, and readily suited to the widest possible utilization in liquid supply controls for heat transfer systems.

These and other objects and advantages of the invention will be apparent from the following description, the accompanying drawings, and the appended claims.

BRIEF DESCRIPTION OF THE DRAWINGS

FIG. 1 is a somewhat figurative perspective illustration, partially broken away, of a heat transfer system incorporating a liquid supply control according to the present invention, and operatively coupled to a liquid heat exchanger for servicing its heat/cold needs;

FIG. 2 is a fragmentary cross-sectional view of the FIG. 1 assembly taken generally on line 2—2 in FIG. 1;

FIG. 3 is a side view of the FIG. 1 assembly taken generally on view line 3—3 in FIG. 1; and FIG. 4 is a general schematic drawing of the control connections for the liquid supply control system.

DESCRIPTION OF THE PREFERRED EMBODIMENT

With reference to the drawings, the new and improved liquid supply control for a heat transfer system for transporting heat by liquid-vapor phase change of a working fluid in a monogroove heat pipe assembly, and the method therefor according to the present invention, will be described. FIG. 1 shows the overall construction of the monogroove liquid heat exchanger 10, which is shown mechanically joined for thermal heat transfer to a liquid heat exchanger 12. Exchanger 10 is in the primary or main thermal loop (not shown); exchanger 12 is in the secondary (also not shown).

The side of the heat transfer interface occupied by exchanger 10 consists of a number of monogroove heat pipe legs 15 welded together at their flanges 17 to form a flat surface 18. Attached to this flat surface 18, either by brazing, bonding, or mechanical clamping, is the compact finned heat exchanger 12 through which secondary loop liquid passes. Heat transfer to the main thermal loop occurs via forced convection in the compact heat exchanger 12 and results in evaporation of liquid in exchanger 10 from fine circumferential grooves 20 machined into the upper (vapor) channel 25 of the monogroove heat pipe legs 15. The vapor channels 25 communicate with their respective liquid channels 27 through the monogroove slots 28 between the two channels 25 and 27 in each leg 15.

For heat transfer from the primary thermal loop to the secondary loop, vapor condenses in the fine circumferential grooves 20. The heat which is thus released is then supplied to the secondary loop by forced convection through exchanger 12. The compact heat exchanger 12 preferably contains two or more fin sections, with the fin density increasing from the inlet 13 to the outlet 14 of the heat exchanger. The purpose of the variable fin density is to increase the overall unit area transfer density as the temperature difference between the heat exchanger 12 fluid and the monogroove 10 fluid decreases, thereby maintaining a nearly constant heat flux along the length of the heat exchanger 12. This increases the total heat transfer compared to a design using a constant fin density.

FIG. 4 shows schematically the instrumentation required to operate the fill valve 30 and the condensate return valve 32 that allow liquid to either enter a reservoir 35 through the fill valve 30 for evaporation, or exit the reservoir 35 through the condensate return valve 32 during operation as a condenser.

During heat transfer from the liquid heat exchanger 12 to the monogroove legs 15, the monogrooves operate as evaporators in the following manner. Liquid is transported from the reservoir 35 to the evaporation sites (grooves 20) by the capillary forces generated by both the fine grooves 20 and the monogroove slot 28 between the two channels 25 and 27. A liquid header 40 serves to connect the liquid channels 27 of the various legs 15 of exchanger 10 with the reservoir 35. As evaporation occurs, liquid is passively drawn into the regions of the exchanger 10 (operating as a cold plate) as needed. Vapor is collected from the vapor channels 25 of the monogroove legs 15 into a single outlet header 42 where it is directed to a condenser (not shown) in another part of the system. A vapor vent line 43 connects the vapor space of the reservoir 35 and the vapor channels 25 of the monogroove legs 15. For operation in O-g, wicking is provided in known manner inside the reservoir 35 to properly position the liquid.

The function of the reservoir 35 is to maintain a supply of liquid that can be utilized passively on demand by the exchanger 10 (when utilized as a cold plate), or similary to collect condensate from exchanger 10 (when utilized as a heat source). Liquid from a pressurized source (not shown) is used to supply the reservoir 35 via solenoid fill valve 30 at the entrance to the reservoir 35 which opens or closes in response to the signals from upper and lower ultrasonic liquid presence sensors 50 and 51 located on the reservoir 35, and flange and vapor thermocouples 55 and 56 located on the heat exchanger 12 and on the vapor header 42, as shown in the drawings. As evaporation occurs, the reservoir 35 will be depleted until both ultrasonic sensors 50 and 51 sense a "dry" condition, therefore providing an empty signal to the controller 60 (FIG. 4). In addition, since heat is being transferred to the monogrooves in this case, the heat exchanger liquid inlet temperature (thermocouple 55) will exceed the vapor temperature (thermocouple 56). This condition, combined with the empty sensor signals will open the fill valve 30 and allow liquid to fill the reservoir 35. As liquid fills the reservoir, the lower sensor 51 will detect liquid first, followed by the upper sensor 50. When both sensors have detected liquid, indicating that the reservoir 35 is full, the solenoid fill valve 30 closes, regardless of the thermocouple signals. Alternatively, the reservoir may have a single sensor that indicates empty and opens the fill valve 30 for a predetermined time that is set to fill the reservoir. After filling is complete, the reservoir sensor will indicate full.

If heat is being transferred to the liquid heat exchanger 12, the monogrooves will be operating as condensers, and the vapor temperature (thermocouple 56) will exceed the heat exchanger liquid inlet temperature (thermocouple 55), since some subcooling will take place. When the difference between these two temperatures exceeds a threshold value, say 5°–10° F., the condensate return valve 32 will open, providing that the ultrasonic sensors 50 and 51 are signalling a full reservoir 35. Liquid will flow under pump suction (not shown) through the condensate return valve 32 and back to the system pump inlet (not shown). When either the reservoir 35 empties or the temperature difference between heat exchanger liquid inlet thermocouple 55 and vapor thermocouple 56 decreases below the threshold value, the condensate return valve 32 will close.

Operation of the valves 30 and 32 with two sensors by controller 60 and in response to the sensors and thermocouples is illustrated by the following chart:

| Ultra-Sonic Sensors | $T_2$–$T_1$ | Return Valve | Fill Valve | Heat Exchanger Operation |
|---|---|---|---|---|
| Full | >X | Open | Closed | Condenser |
| Empty | >X | Closed | Closed | Condenser |
| Empty | <O | Closed | Open | Evaporator |
| Full | <O | Closed | Closed | Evaporator |

where $T_2$ is the vapor temperature, $T_1$ is the heat exchanger liquid inlet temperature, and X is a predetermined value which is preset $\geqq 0$.

As may be seen, therefore, the present invention has numerous advantages and offers important improvements over the prior art. For example, reservoir 35 solves the problems associated with system designs wherein liquid was pumped directly into the monogroove legs under the control of an ultrasonic sensor located on one of the legs. As previously described, this prior art configuration resulted in uneven flow distribution between the legs and local heating effects, so that the sensor was found not always to control the solenoid valve properly, which in turn sometimes caused flooding of the plate and excess liquid exiting the plate along with the vapor stream. But with the present invention, the reservoir 35 allows liquid to be transported passively upon demand into and out of each of the legs 15 of the heat exchanger 10. The problem of uneven flow distribution is thus eliminated by the present invention.

Another advantage of the present invention is the control logic, summarized in the chart above. Thus far it has proved reliable and effective in all test conditions.

As a further advantage, the monogroove liquid heat exchanger operated and supplied according to the present invention provides good evaporative heat transfer by virtue of surface evaporation from the many sites in the circumferentially grooved section, with a demonstrated heat flux capability of greater than 2 W/sq. cm with ammonia, as well as good load sharing performance.

Finally, since the valves 30 and 32 enable the use of a pressurized/suctioned liquid supply/return, the exchangers can be operated at relatively large height differences from others in the system, thereby facilitating ground testing.

While the methods and forms of apparatus herein described constitute preferred embodiments of this invention, it is to be understood that the invention is not limited to these precise methods and forms of apparatus, and that changes may be made therein without departing from the scope of the invention.

What is claimed is:

1. A liquid supply control for a heat transfer system for transporting heat by liquid-vapor phase change of a working fluid in a monogoove heat pipe assembly, comprising:

(a) a monogroove heat pipe assembly formed of a plurality of monogroove heat pipe legs joined to one another, said heat pipe assembly including liquid and vapor headers coupled respectively to the liquid and vapor channels of said monogroove heat pipe legs in said assembly, (b) a liquid reservoir connected to said liquid header, (c) a vapor line for the working fluid vapor phase, said vapor line being operatively connected to a condenser and to said vapor header for supplying and receiving vapor according to the demands of said header, (d) liquid supply and condensate return lines for the liquid phase of the working fluid, (e) a fill valve operatively connecting said liquid supply line from a liquid source to said liquid reservoir, (f) a condensate return valve operatively connecting said condensate return line from a system pump to said liquid reservoir, and (g) valve control means responsive at least to liquid in said reservoir and connected to said fill and return valves for controlling said valves to admit liquid to said reservoir when said reservoir is becoming depleted and to drain liquid from said reservoir when said reservoir is becoming filled, to cause liquid to enter said reservoir when said heat pipe assembly is evaporating the working fluid, and to cause liquid to exit said reservoir during operation of said heat pipe assembly as a condenser for the working fluid.

2. The system of claim 1 wherein said heat pipe legs further comprise grooved capillary plate heat exchangers.

3. The system of claim 1 further comprising liquid presence sensing means located on said liquid reservoir and connected to said valve control means for indicating the presence of liquid in said reservoir.

4. The system of claim 3 wherein said liquid presence sensing means further comprises at least two ultrasonic liquid presence sensors located to detect low and high liquid levels in said reservoir.

5. The system of claim 1 further comprising liquid heat exchanger means attached to said heat pipe assembly for cooling and/or heating liquid.

6. The system of claim 5 further comprising temperature sensing means connected to said valve control means and located for sensing the vapor temperature and the temperature of said heat exchanger.

7. The system of claim 6 wherein said temperature sensing means further comprises at least two thermocouples, one located on said heat exchanger, and the other on said vapor line.

8. The system of claim 5 further comprising:

(a) liquid sensing means connected to said valve control means and located on said liquid reservoir for indicating the amount of liquid in said reservoir, and (b) temperature sensing means connected to said valve control means and located for sensing the vapor temperature and the temperature of said heat exchanger.

9. The system of claim 8 wherein said valve control means further comprises means for:

(a) opening said condensate return valve and closing said fill valve when said liquid sensing means indicates that said reservoir is substantially full and said temperature sensing means indicates that said vapor temperature is greater than said heat exchanger temperature by a predetermined amount, (b) closing said condensate return and said fill valves when said liquid sensing means indicates that said reservoir is substantially empty and said temperature sensing means indicates that said vapor temperature is greater than said heat exchanger temperature by a predetermined amount, (c) closing said condensate return valve and opening said fill valve when said liquid sensing means indicates that said reservoir is substantially empty and said temperature sensing means indicates that said vapor temperature is less than said heat exchanger temperature, and (d) closing said condensate return and said fill valves when said liquid sensing means indicates that said reservoir is substantially full and said temperature sensing means indicates that said vapor temperature is less than said heat exchanger temperature.

10. A liquid supply control for a heat transfer system for transporting heat by liquid-vapor phase change of a working fluid in a monogroove heat pipe assembly, comprising:

(a) a monogroove heat pipe assembly formed of a plurality of flanged monogroove capillary plate heat pipe legs joined to one another at their flanges to form a flat surface, said heat pipe assembly including liquid and vapor headers coupled respectively to the liquid and vapor channels of each said monogroove heat pipe leg in said assembly, (b) liquid heat exchanger means attached to said heat pipe assembly for cooling and/or heating liquid, said heat exchanger means having liquid inlet and outlet lines, (c) a liquid reservoir connected to said liquid header for passively supplying liquid to and receiving liquid from said heat pipe legs upon demand, (d) a vapor line for working fluid vapor phase, said vapor line being operatively connected to a condenser and to said vapor header for supplying and receiving vapor according to the demands of said header, (e) liquid supply and condensate return lines for the liquid phase of the working fluid, (f) a fill valve operatively connecting said liquid supply line from a liquid source to said liquid reservoir, (g) a condensate return valve operatively connecting said condensate return line from said liquid reservoir to a system pump, (h) liquid presence sensing means connected to said valve control means and located on said liquid reservoir for indicating the presence of liquid in said reservoir, said liquid presence sensing means including at least two ultrasonic liquid presence sensors located to detect low and high liquid levels in said reservoir, (i) temperature sensing means connected to said valve control means and located for sensing the vapor temperature of said heat pipe assembly and for sensing the temperature of said heat exchanger, said temperature sensing means including at least two thermocouples, one located on said heat exchanger liquid inlet line and the other on said vapor line, and (j) valve control means responsive to said assembly and exchanger temperatures and said reservoir liquid presence sensors and connected to said fill and return valves for controlling said valves by:

(i) opening said condensate return valve and closing said fill valve when said ultrasonic sensors indicate that said reservoir is substantially full and said thermocouples indicate that said vapor temperature is greater than said liquid inlet temperature by a predetermined amount, (ii) closing said condensate return and said fill valves when said ultrasonic sensors indicate that said reservoir is substantially empty and said thermocouples indicate that said vapor temperature is greater than said liquid inlet temperature by a predetermined amount, (iii) closing said condensate return valve and opening said fill valve when said ultrasonic sensors indicate that said reservoir is substantially empty and said thermocouples indicate that said vapor temperature is less than said liquid inlet temperature, and (iv) closing said condensate return and said fill valves when said ultrasonic sensors indicate that said reservoir is substantially full and said thermocouples indicate that said vapor temperature is less than said liquid inlet temperature, to admit liquid to said reservoir when said reservoir is becoming depleted and to drain liquid from said reservoir when said reservoir is becoming filled, to cause liquid to enter said reservoir through said fill valve when said heat pipe assembly is evaporating the working fluid, and to cause liquid to exit said reservoir through said condensate return valve during operation of said heat pipe assembly as a condenser for the working fluid.

11. A liquid supply control method for a heat transfer system for transporting heat by liquid-vapor phase change of a working fluid in a monogroove heat pipe assembly, comprising:

by responding at least to liquid in the liquid reservoir for a monogroove heat pipe assembly, wherein the assembly is formed of a plurality of monogroove heat pipe legs joined to one another, the heat pipe assembly includes liquid and vapor headers coupled respectively to the liquid and vapor channels of the monogroove heat pipe legs in the assembly, the liquid reservoir is connected to the liquid header, a vapor line for the working fluid vapor phase is operatively connected to a condenser and to the vapor header for supplying and receiving vapor according to the demand of the header, and liquid supply and condensate return lines are provided for the liquid phase of the working fluid, performing the steps of:

(a) admitting liquid to the reservoir from a liquid supply via the liquid supply line when the reservoir is becoming depleted to cause liquid to enter the reservoir when the heat pipe assembly is evaporating the working fluid, and (b) draining liquid from the reservoir into a system pump via the condensate return line when the reservoir is becoming filled to cause liquid to exit the reservoir during operation of the heat pipe assembly as a condenser for the working fluid.

12. The method of claim 11 wherein the heat pipe legs are grooved capillary plate heat exchangers.

13. The method of claim 11 further comprising indicating the presence of liquid in the reservoir with a liquid presence sensing means located on the liquid reservoir.

14. The method of claim 13 further comprising detecting low and high liquid levels in the reservoir with a liquid presence sensing means which includes at least two ultrasonic liquid presence sensors located to detect such low and high liquid levels in the reservoir.

15. The method of claim 11 wherein a liquid heat exchanger means is attached to said heat pipe assembly for cooling and/or heating liquid.

16. The method of claim 15 further comprising sensing the vapor temperature and the temperature of the heat pipe assembly with a temperature sensing means located for sensing the vapor temperature and the temperature of the heat exchanger.

17. The method of claim 16 further comprising sensing the vapor temperature and the temperature of the heat pipe assembly with at least two thermocouples, one located on the heat exchanger and the other on the vapor line.

18. The method of claim 15 further comprising:

(a) indicating the amount of liquid in the reservoir with a liquid sensing means located on the liquid reservoir, and (b) sensing the vapor temperature and the temperature of the heat pipe assembly with a temperature sensing means located for sensing the vapor temperature and the temperature of the heat exchanger.

19. The method of claim 18 wherein said admitting and draining steps further comprise:

(a) opening a condensate return valve in the condensate return line and closing a fill valve in the liquid supply line when the liquid sensing means indicates that the reservoir is substantially full and the temperature sensing means indicates that the vapor temperature is greater than the heat exchanger temperature by a predetermined amount, (b) closing the condensate return and the fill valves when the liquid sensing means indicates that the reservoir is substantially empty and the temperature sensing means indicates that the vapor temperature is greater than the heat exchanger temperature by a predetermined amount, (c) closing the condensate return valve and opening the fill valve when the liquid sensing means indicates that the reservoir is substantially empty and the temperature sensing means indicates that the vapor temperature is less than the heat exchanger temperature, and (d) closing the condensate return and the fill valves when the liquid sensing means indicates that the reservoir is substantially full and the temperature sensing means indicates that the vapor temperature is less than the heat exchanger temperature.

20. A liquid supply control method for a heat transfer system for transporting heat by liquid-vapor phase change of a working fluid in a monogroove heat pipe assembly, comprising:

by responding at least to liquid in the liquid reservoir for a monogroove heat pipe assembly, wherein the assembly is formed of a plurality of flanged monogroove capillary plate heat pipe legs joined to one another at their flanges to form a flat surface, the heat pipe assembly includes liquid and vapor headers coupled respectively to the liquid and vapor channels of each monogroove heat pipe leg in the assembly, a liquid heat exchanger means in attached to the heat pipe assembly for cooling and/or heating liquid, the heat exchanger means has liquid inlet and outlet lines, the liquid reservoir is connected to the liquid header for passivêly supplying liquid to and receiving liquid from the heat pipe legs upon demand, a vapor line for the working fluid vapor phase is operatively connected to a condenser and to the vapor header for supplying and receiving vapor according to the demands of the header, liquid supply and condensate return lines are provided for the liquid phase of the working fluid, a fill valve operatively connects the liquid supply line from a liquid supply to the liquid reservoir, a condensate return valve operatively connects the condensate return line to the liquid reservoir and to a system pump, a liquid presence sensing means connected to the valve control means and located on the liquid reservoir indicates the presence of liquid in the reservoir, the liquid presence sensing means includes at least two ultrasonic liquid presence sensors located to detect low and high liquid levels in the reservoir, a temperature sensing means connected to the valve control means is located for sensing the vapor temperature of the heat pipe assembly and for sensing the temperature of the heat exchanger, and the temperature sensing means includes at least two thermocouples, one located on the heat exchanger liquid inlet line and the other on the vapor line, performing the steps, responsively to the assembly and exchanger temperatures and the reservoir liquid presence sensors, of:

(a) opening the condensate return valve and closing the fill valve when the ultrasonic sensor indicate that the reservoir is substantially full and the thermocouples indicate that the vapor temperature is greater than the liquid inlet temperature by a predetermined amount, (b) closing the condensate return and the fill valves when the ultrasonic sensors indicate that the reservoir is substantially empty and the thermocouples indicate that the vapor temperature is greater than the liquid inlet temperature by a predetermined amount, (c) closing the condensate return valve and opening the fill valve when the ultrasonic sensors indicate that the reservoir is substantially empty and the thermocouples indicate that the vapor temperature is less than the liquid inlet temperature, and (d) closing the condensate return and the fill valves when the ultrasonic sensors indicates that the reservoir is substantially full and the thermocouples indicate that the vapor temperature is less than the liquid inlet temperature, to admit liquid to the reservoir when the reservoir is becoming depleted and to drain liquid form the reservoir when the reservoir is becoming filled, to cause liquid to enter the reservoir through the fill valve when the heat pipe assembly is evaporating the working fluid, and to cause liquid to exit the reservoir during operation of the heat pipe assembly as a condenser for the working fluid.

* * * * *